US006019634A

United States Patent [19]

Tseng

[11] Patent Number: 6,019,634

[45] Date of Patent: Feb. 1, 2000

[54] SOCKET FOR AN ORNAMENTAL BULB

[76] Inventor: Jeou-Nan Tseng, No. 539, Sec. 4, Chunghua Rd., Hsinchu, Taiwan

[21] Appl. No.: 09/293,274

[22] Filed: Apr. 16, 1999

[51] Int. Cl.[7] ..... H01R 13/60

[52] U.S. Cl. ..... 439/574; 439/574; 439/575; 439/661; 439/619; 362/226; 313/318.1

[58] Field of Search ..... 439/574, 575, 439/661, 619, 248; 362/226, 800; 313/318.01, 318.07

[56] References Cited

U.S. PATENT DOCUMENTS

| | | | |
|---|---|---|---|
| 4,970,632 | 11/1990 | Tseng | 362/226 |
| 5,531,610 | 7/1996 | Chen | 439/356 |
| 5,584,567 | 12/1996 | Rumpel | 362/249 |
| 5,595,439 | 1/1997 | Maddock et al. | 362/238 |
| 5,613,870 | 3/1997 | Traver, Jr. | 439/352 |
| 5,941,628 | 8/1999 | Chang | 362/249 |

*Primary Examiner*—Paula Bradley
*Assistant Examiner*—Truc Nguyen
*Attorney, Agent, or Firm*—Kolisch Hartwell Dickinson McCormack & Heuser

[57] ABSTRACT

A socket for an ornamental bulb has at least one pair of parallel extensions each respectively having a key and a keyslot formed on distal ends thereof. The key is formed to be detachable received in the keyslot, such that the socket can hold objects received between the extensions which are engaged with each other. The key has a neck and a head, with the head having a width larger than that of the neck. The keyslot is defined by two parallel clamping pieces perpendicular to the extensions and has a width the same as the head, such that when the head is received in the keyslot, the extensions are securely engaged with each other and the objects are securely clamped.

7 Claims, 6 Drawing Sheets

SOCKET FOR AN ORNAMENTAL BULB

BACKGROUND OF THE INVENTION

1. Field of the Invention

The present invention relates to a socket for an ornamental bulb, particularly to a socket having a fastening structure so that the socket can be attached to any suitable location.

2. Description of Related Art

Generally speaking, ornamental bulbs are connected in strings by electrical wires. When used, the ornamental bulbs are hung on locations suitable for hanging the wires. Therefore, locations for hanging conventional ornamental bulbs are limited by the wire.

The present invention aims to provide an improved socket for an ornamental bulb to mitigate and/or obviate the aforementioned problems.

SUMMARY OF THE INVENTION

The main object of the present invention is to provide a socket for an ornamental light. The socket forms a fastening structure therewith, such that the socket can be held in any suitable location.

To accomplish the object, the fastening structure has a pair of parallel extensions integrally extending from the side of the socket. Distal ends of the extensions respectively have a key and a keyslot detachably receiving the key therein. The key has a neck and a head formed on the distal end thereof. The keyslot is defined to receive the head therein and has a clamp formed on the open side thereof. The keyslot has a thickness the same as that of the head but the clamp has a thickness smaller than that of the head, so that when the key is received in the keyslot, the two extensions will be securely engaged with each other.

The detailed features of the present invention will be apparent in the detailed description with appropriate reference to the accompanying drawings.

DETAILED DESCRIPTION OF PREFERRED EMBODIMENT

Figure 1:
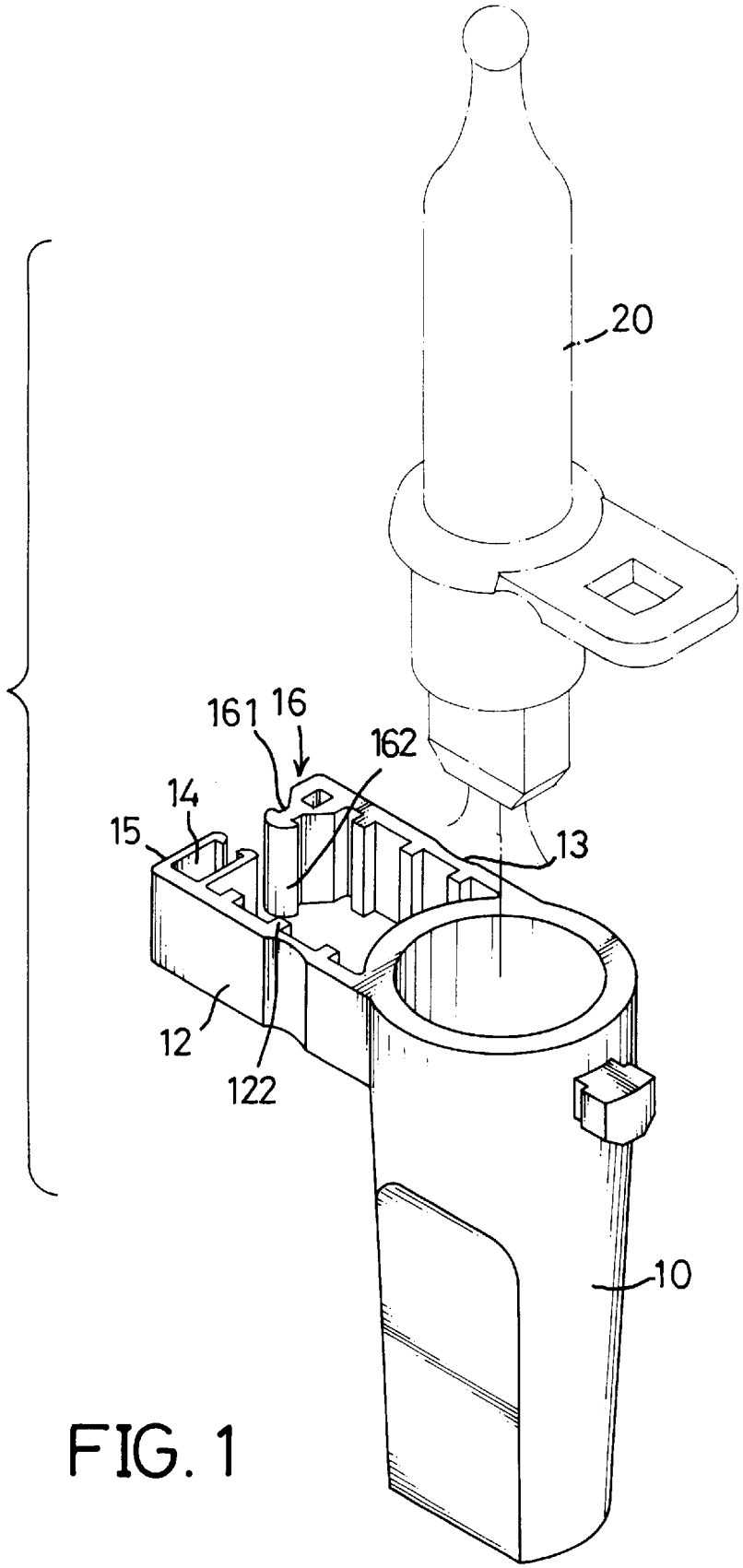
FIG. 1 is an exploded perspective view of a socket in accordance with the present invention.
Figure 2:
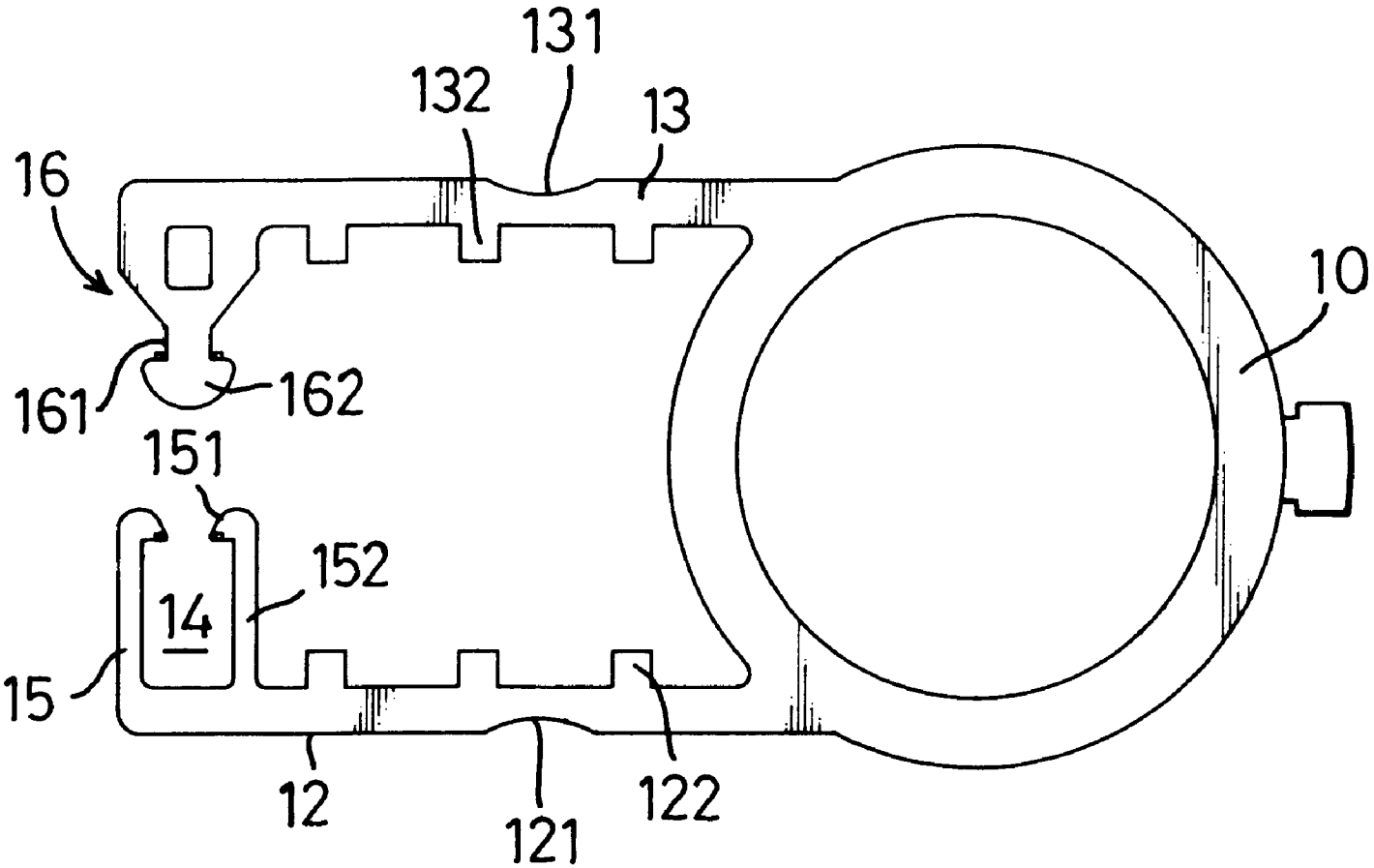
FIG. 2 is a top plan view of the socket in FIG. 1.

The present invention relates to a socket of an ornamental bulb. As shown in FIGS. 1 and 2, a socket (10) defines a hole (not numbered) for receiving a bulb (20) therein. Particularly, a first extension (12) and a second extension (13) parallel to the first extension (12) are integrally formed on the side of the socket (10). The free ends of the first and second extensions (12, 13) respectively form a keyslot (14) and a key (16). The keyslot (14) is defined by a pair of parallel clamping pieces (15) perpendicularly formed on the inside of the distal end of the first extension (12). The key (16) has a neck (161) and a head (162) formed on the distal end thereof. The head (162) has a width the same as that of the keyslot (14) but larger than that of the neck (161). Furthermore, the distal ends of the clamping pieces (15) integrally and respectively form hooks (151). The width between the tip of the two opposite hooks (151) is equal to the width of the neck (161). The first and second extensions (12, 13) are made of flexible material, such as plastic, so as to provide sufficient flexibility thereto when the key (16) is received in the keyslot (14). To enhance the flexibility of the first and the second extensions (12, 13), an arcuate cutout (121, 131) is respectively defined in the side face of the first extension (12) and the second extension (13), as shown in FIG. 2.

Figure 3:
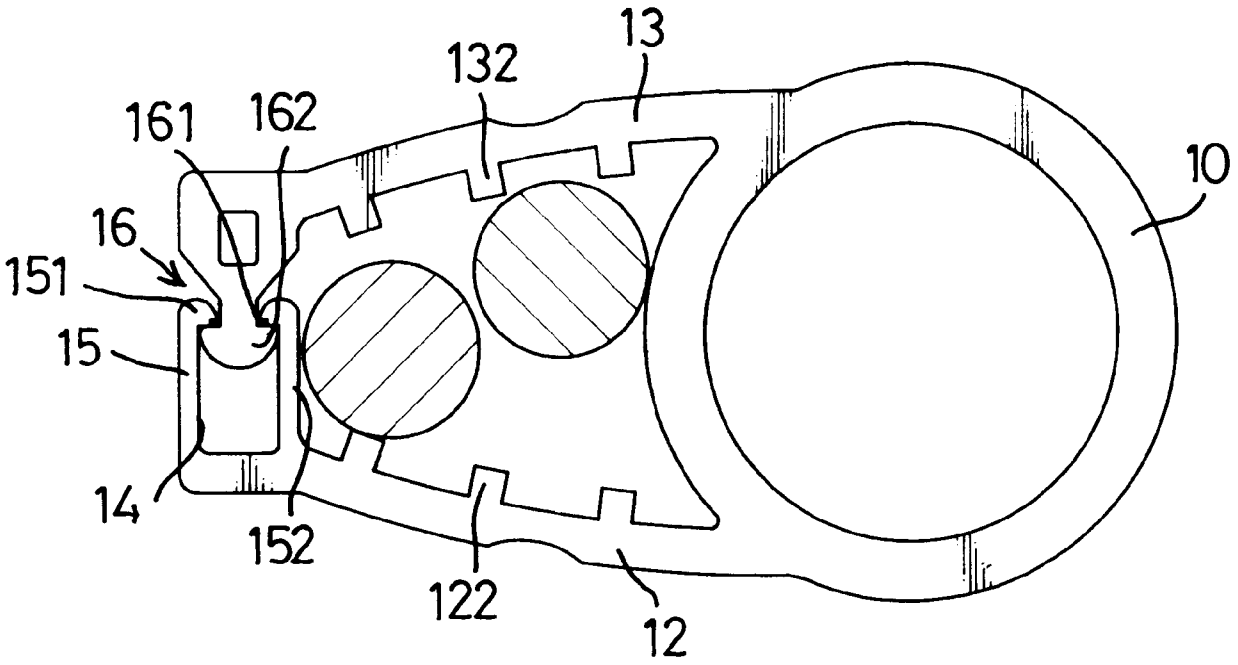
FIG. 3 is a top plan view of the socket in FIG. 1 showing the two extensions engaged with each other, whereby objects can be clamped between the extensions.

Referring to FIG. 3, when the key (16) is received in the keyslot (14) between the clamping pieces (15), due to the width relationship therebetween, the head (162) is securely held in the keyslot (14) by the hooks (151). It is noted that before the engagement between the key (16) and the keyslot (14), the user is able to hang the socket (10) of the invention on objects such as twigs, wires, and then engage the key (16) with the keyslot (14). Thereafter, the socket (10) of the invention can be hung on any suitable location with the help of the first and second extensions (12,13). For the purpose of increasing friction between objects received in the keyslot (14), a plurality of ridges (122,132) are respectively formed on the inner face of the first extension (12) and the second extension (13).

Figure 4:
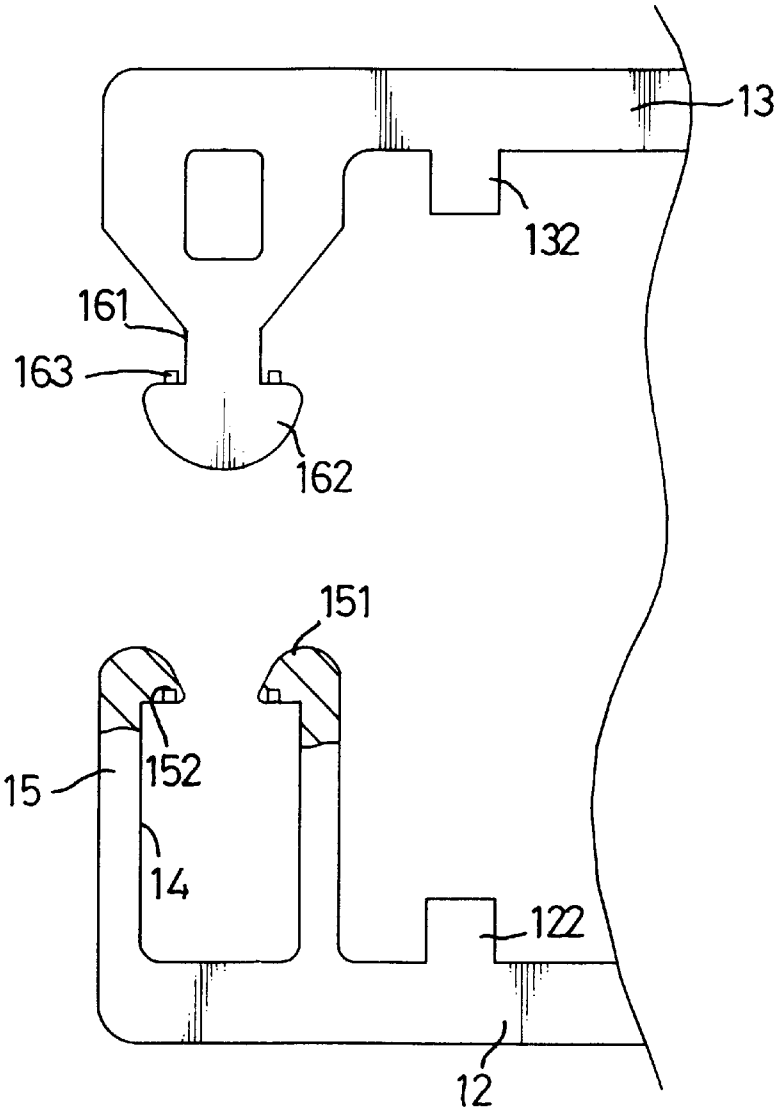
FIG. 4 is a schematic plan view showing another embodiment of the fastening structure of the socket in accordance with the invention.

As shown in FIG. 4, to enhance the engagement between the key (16) and the keyslot (14), at least one boss (163) is formed on a side face of the head (162) and at least one recess (152) corresponding to the boss (163) is defined in a side face of the hook (151). Therefore, when the head (162) is received in the keyslot (14), the boss (163) received in the corresponding recess (152) will further increase the grip between the first and the second extensions (12, 13).

Figure 5:
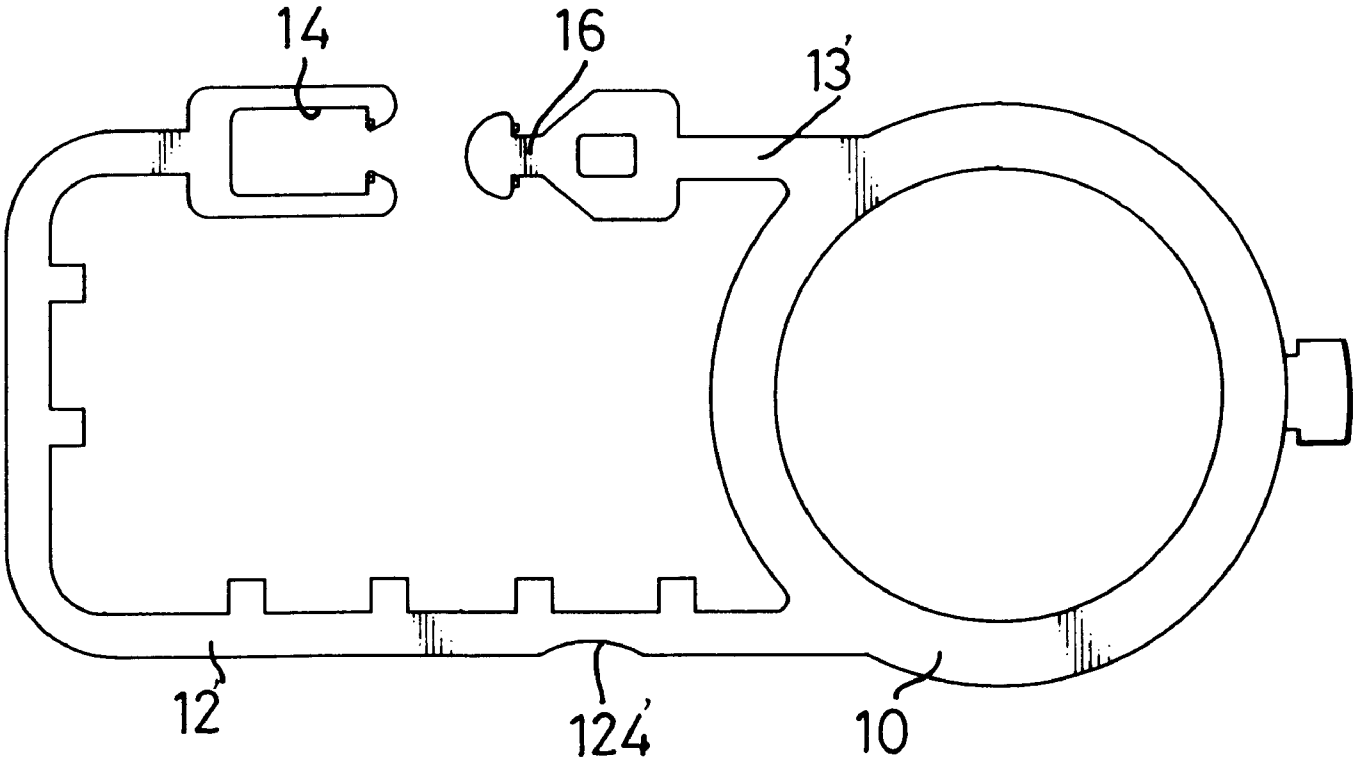
FIG. 5 is a top plan view of another embodiment of the present invention.

Referring to FIG. 5, the socket (10) extensions (12', 13') in accordance with the invention are rectangular-shaped. The structure of distal ends of the rectangular-shaped extensions (12', 13') is the same as discussed before. The only difference is that the rectangular-shaped extension (12') still has an arcuate recess (124') defined in a side face thereof, but the extension (13') does not.

Figure 6:
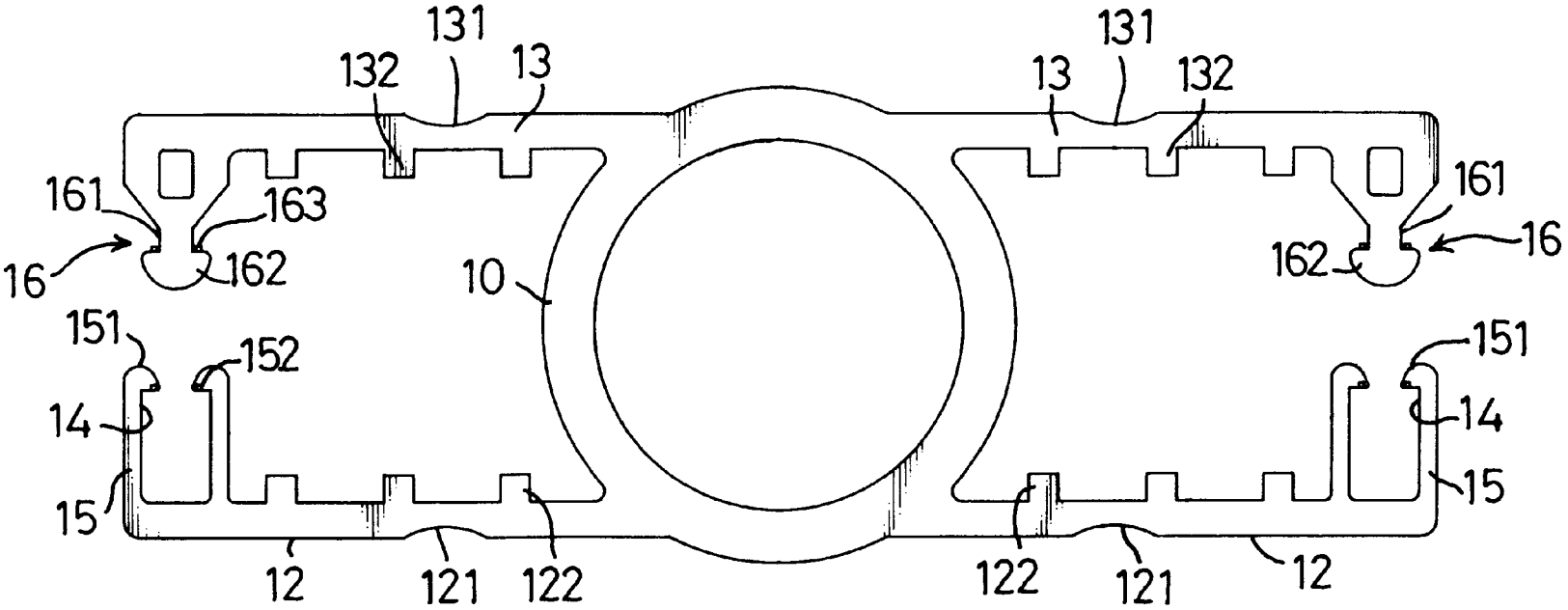
FIG. 6 is a top plan view of still another embodiment of the present invention.

As discussed before, the socket (10) of the invention has a fastening structure including a parallel first extension (12) and second extension (13) pair integrally formed on the side thereof. However as shown in FIG. 6, for special purposes, each socket (10) in accordance with the invention may have two pairs of fastening structures each having the same structure as previously described and located on opposite sides of the socket.

What is claimed is:

1. A socket for an ornamental bulb comprising:

at least a first extension (12) and a second extension (13) parallel to the first extension (12) and both integrally formed on the side thereof;

wherein the distal end of the first extension (12) has a keyslot (14) defined by a pair of clamping pieces (15) perpendicular with respect to the first extension (12) and a distal end of the second extension (13) has a key (16) to be detachably received in the keyslot (14).

2. The socket as claimed in claim 1, wherein the distal end of each clamping piece (15) forms a hook (151), and the key (16) has a neck (161) and a head (162);

wherein the width of the neck (161) is the same as that between the tips of the hooks (151), and the width of the head (162) is the same as that of the keyslot (14) but larger than that between the tips of the hooks (151).

3. The socket as claimed in claim 2, wherein at least one recess (152) is defined in the face of the hook (151) and a boss (163) corresponding to the recess (152) is formed on the face of the head (162), whereby the boss (163) is detachable received in the corresponding recess (152) when the head (162) is received in the keyslot (14).

4. The socket as claimed in claim 3, wherein multiple ridges (122, 132) are respectively formed on the inner face of the first extension (12) and the second extension (13) respectively.

5. The socket as claimed in claim 2, wherein at least one arcuate recess (124) is defined in the first extension (12), so as to increase the flexibility thereof.

6. The socket as claimed in claim 5, wherein at least one arcuate recess (131) is defined in the second extension (13), so as to increase the flexibility thereof.

7. The socket as claimed in claim 5, the first extension (12) is rectangular-shaped.

* * * * *